United States Patent [19]

Kingsford

[11] Patent Number: 4,898,283

[45] Date of Patent: Feb. 6, 1990

[54] MOVEABLE DISPLAY RACK ASSEMBLY

[75] Inventor: Ted Kingsford, Memphis, Tenn.

[73] Assignee: Plough, Inc., Memphis, Tenn.

[21] Appl. No.: 241,161

[22] Filed: Sep. 6, 1988

[51] Int. Cl.[4] ..... A47F 7/00

[52] U.S. Cl. ..... 211/57.1; 211/59.1; 211/162; 211/175

[58] Field of Search ..... 211/162, 175, 59.1, 211/57.1, 180; 312/301; 108/61

[56] References Cited

U.S. PATENT DOCUMENTS

| | | | |
|---|---|---|---|
| 2,098,828 | 11/1937 | Ludwick | 211/34 |
| 3,570,683 | 3/1971 | Dickgiesser et al. | 211/162 |
| 3,732,633 | 5/1973 | Margolis et al. | 211/162 |
| 3,750,893 | 8/1973 | Kempler | 211/162 |
| 3,883,004 | 5/1975 | Slaga | 211/162 |
| 4,008,807 | 2/1977 | Phillips | 211/162 X |
| 4,123,126 | 10/1978 | Querengasser | 211/162 X |
| 4,171,052 | 10/1979 | Winn | 211/162 |
| 4,190,166 | 2/1980 | Allsop | 211/60 R |
| 4,773,546 | 9/1988 | Konstant | 211/162 X |

FOREIGN PATENT DOCUMENTS

| | | | |
|---|---|---|---|
| 100443 | 11/1964 | Denmark | 211/162 |

*Primary Examiner*—Ramon S. Britts
*Assistant Examiner*—David G. Kolman
*Attorney, Agent, or Firm*—Gerald S. Rosen; Thomas D. Hoffman; Stephen I. Miller

[57] ABSTRACT

A movable display assembly for use with a fixed display wall includes a stationary base positioned horizontally in front of and at the lower end of the fixed display wall; a pair of spaced apart parallel tracks extending parallel to the fixed display wall and mounted on the stationary base; a trolley movably mounted on the tracks, each trolley including a plurality of rollers which ride within the tracks and thereby movably support the trolley therealong; an inverted substantially U-shaped rack formed from a tubular member for supporting a plurality of articles thereon, the rack including a lower end fixedly supported on the trolley and an upper free end, with a transparent pegboard supported by the rack for supporting the plurality of articles thereon.

26 Claims, 2 Drawing Sheets

MOVEABLE DISPLAY RACK ASSEMBLY

BACKGROUND OF THE INVENTION

The present invention relates generally to display racks for displaying merchandise and, more particularly, is directed to a display rack slidably mounted in front of a fixed display wall.

When displaying articles in a retail store, it is desirable that the articles be in plain sight for inspection and purchase by a customer. In this regard, it is well-known to erect fixed pegboard-type walls on which the articles can be easily mounted by store personnel, and can be viewed and removed by a customer. However, even with such arrangement, the amount of space available for mounting the articles is limited.

In this regard, it has been suggested to slidably mount at least one pegboard-type panel in front of the fixed display wall for mounting additional articles thereon. The area in front of each fixed display wall is thereby utilized to maximum efficiency, while still permitting the customer to view and remove articles on any of the movable display panels and from the fixed display wall. With this known arrangement, the vertical display panels have either their top or bottom edges slidably supported or mounted in a track and the opposite edge guided within an additional track in order to prevent the vertical display panels from tipping. Specifically, such conventional assemblies include rollers mounted to the lower edge of each panel for slidably supporting the panel, or alternatively, rollers secured to the upper edge of each panel for slidably supporting the panel in a track in a hanging manner. In either case, a track is provided at the opposite edge of the panel for guiding the same and preventing the panel from tipping forwardly or rearwardly. In this regard the following references are representative of such known arrangements.

Slaga U.S. Pat. No. 3,883,004 discloses a cantilever movable panel display rack in which a plurality of panels having pegboard holes therein are slidably disposed in a vertical and parallel relationship in front of a fixed back display wall.

Rollers are provided at the upper end of each panel, by which the panel is slidably suspended from an upper track in the top section of the rack. The bottom of each panel is slidably guided within tracks at the base of the rack so as to maintain the panels in the aforementioned vertical and parallel relationship. However, because upper and lower tracks are required, the upper tracks for supporting the panels and the lower tracks for guiding the panels, there is an increase in the complexity and cost of the display rack. In addition, because the panels are supported solely at their upper ends, the upper end of each panel must be made from a steel sheet and is reinforced by an additional plate or sheet to provide the necessary rigidity and strength to the structure. Still further, because of the use of overhanging tracks to support the panels, additional track supporting structure must be provided for supporting the tracks, thereby further adding to the cost and complexity of the rack.

Kempler U.S. Pat. No. 3,750,893 discloses a small article display rack which is substantially identical in all relevant aspects to U.S. Patent No. 3,883,004 to Slaga. Accordingly, the same remarks made in regard to Slaga also apply to Kempler.

Winn U.S. Pat. No. 4,171,052 discloses a merchandise display unit in which a plurality of panels having pegboard holes therein are slidably disposed in a vertical and parallel relationship in front of a fixed back display panel, in much the same arrangement as in Slaga U.S. Pat. No. 3,883,004. With Winn, however, the panels are slidably supported in bottom tracks by means of ball bearings. In order to maintain the vertical and parallel relationship of the panels, upper tracks are provided for receiving the upper ends of the panels. Therefore, it is necessary to provide an overhanging structure and upper tracks, adding to the complexity and cost of the display unit.

Ludwick U.S. Pat. No. 2,098,828 discloses a display rack similar to Winn. Specifically, a display rack is movably disposed in front of a fixed shelf, the unit being particularly suited to the storing of boxes of shoes. The bottom of the display rack includes grooved rollers which ride on a track on the base. The upper end of the display rack includes a member which is constrained to move between two parallel guide members, with the explicit purpose of the latter being to prevent the movable rack from tipping rearwardly or forwardly. However, because of the use of an overhanging support and the upper guide members, the complexity and cost of the display unit is increased.

Dickgiesser U.S. Pat. No. 3,570,683 discloses a movable support panel assembly comprised of a plurality of modular panels. The support for this assembly is similar to that of Winn and Ludwick. Specifically, a plurality of sets of rollers are provided on the bottom of the assembly for movably supporting the assembly on a base. No track is provided for the lower support rollers. In order to guide the assembly during movement thereof, the upper end of the assembly is provided with a guide roller which rides within an upper track. However, as with Winn and Ludwick, because of the use of an upper support and the upper guide assembly comprised of the upper track and the upper guide roller, the complexity and cost of the display unit is increased.

Thus, a problem with all of the aforementioned references is that upper and lower tracks must be provided for supporting and guiding the movable display racks. This, of course, results in an increase in the complexity and cost of the system.

Allsop U.S. Pat. No. 4,190,166 discloses a ski pole mounting assembly including a plurality of platforms slidably mounted on a base by means of rollers on the underside of each platform, each roller riding on the upper surface of the base. A tracking member extends centrally from the underside of each platform and is guided within a U-shaped rail member on the base, so as to guide the movement of each platform on the base. A plurality of stud members are mounted on each platform, with each stud member extending upwardly from the platform and having a hollow, frustoconical configuration. A socket member is inserted into each such stud member. Such arrangement is only provided, however, so that each socket member can hold a ski pole in an upright position. Thus, the assembly of this patent has no relation to a display rack in which there is a front, vertically oriented movable pegboard-type panel for holding a plurality of items and a back, fixed pegboard-type panel for also holding a plurality of items, such that maximum utilization of floor space in a store is achieved.

OBJECTS AND SUMMARY OF THE INVENTION

Accordingly, it is an object of the present invention to provide a movable display rack that overcomes the aforementioned problems encountered in the prior art.

It is another object of the present invention to provide a movable display rack that is free standing.

It is still another object of the present invention to provide a movable display rack that is easily and stably mounted at its lower end only on a base in front of a fixed display wall by means of a movable trolley.

It is yet another object of the present invention to provide a movable display rack of the aforementioned type in which the movable trolley is slidably mounted in a stable manner on two spaced tracks.

It is a further object of the present invention to provide a movable display rack that is relatively easy and economical to manufacture and use.

In accordance with an aspect of the present invention, a movable display assembly for use with a fixed display wall, includes a stationary base positioned in front of the fixed display wall; upright rack means for supporting a plurality of articles thereon, said upright rack means including a lower end and an upper free end; and means for movably supporting the lower end on the stationary base.

In accordance with another aspect of the present invention, a movable display assembly for use with a fixed display wall includes a stationary base positioned in front of the fixed display wall; a trolley; means for movably supporting the trolley on the base; and upright rack means for supporting a plurality of articles thereon, said upright rack means including a lower end fixedly supported on the trolley and an upper free end.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
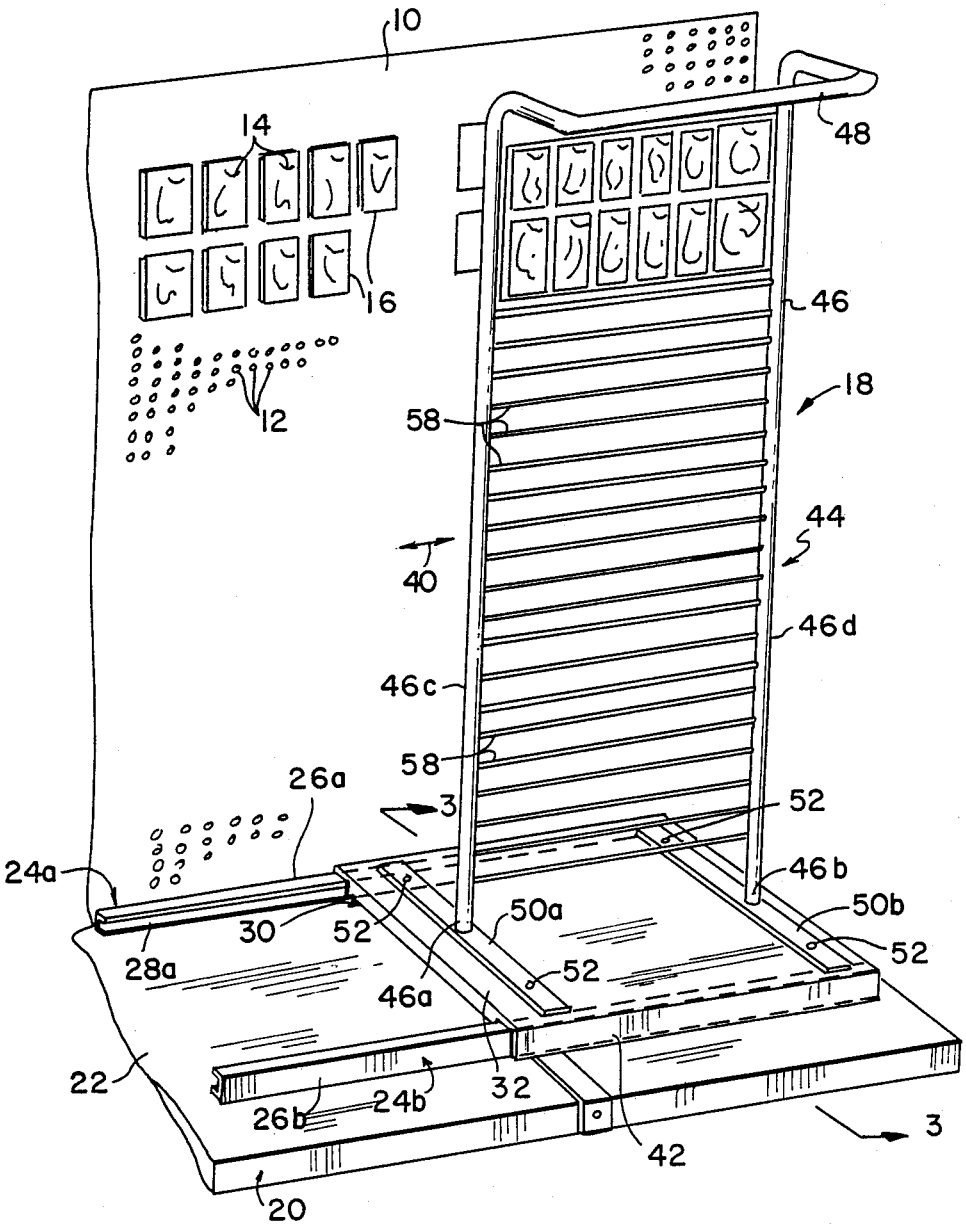
FIG. 1 is a perspective view of a movable display rack assembly according to one embodiment of the present invention.
Figure 2:
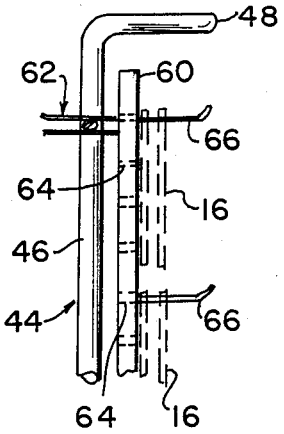
FIG. 2 is a side elevational view of an upper portion of the movable display rack assembly of FIG. 1.
Figure 3:
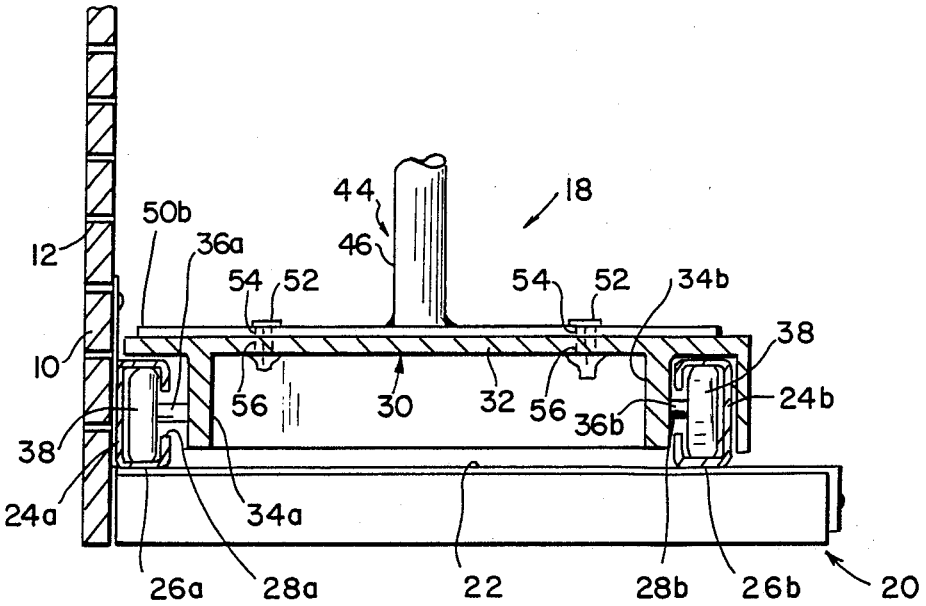
FIG. 3 is a cross-sectional view of the movable display rack assembly of FIG. 1, taken along line 3—3 thereof.

Referring to the drawings in detail, and initially to FIGS. 1–3 thereof, a fixed display wall 10 which may be a pegboard having a plurality of holes 12 therein, is permanently mounted on a wall in a retail store. A plurality hooks 14 are inserted within holes 12 and extend horizontally outward therefrom for holding a plurality of articles 16 which, for example, may be held in a blister pack or other suitable container. As aforementioned, however, the use of only a single vertical wall 10 greatly limits the amount of usable space in the store.

In accordance with the present invention, a movable display rack assembly 18 is provided for holding additional articles 16 in front of fixed display wall 10. Specifically, movable display rack assembly 18 includes a stationary base 20 fixedly mounted at the lower end and in front of fixed display wall 10. In this regard, stationary base 20 can be comprised of a store gondola that is normally positioned at the lower end of fixed display wall 10 for holding loose merchandise. Thus, stationary base 20 provides an upper, horizontally oriented surface 22 at the lower end of fixed display wall 10. In accordance with the present invention, two parallel tracks **24*a* and 24*b* are fixedly mounted on upper surface 22 of stationary base 20 in spaced relation, parallel to fixed display wall 10, that is, along the lengthwise direction thereof. As shown best in FIG. 3, tracks 24*a* and 24*b* are each comprised of a C-shaped rail 26*a* and 26*b* containing an opening 28*a* and 28*b*, respectively in sidewalls thereof, with openings 28*a* and 28*b* facing each other. Tracks 24*a* and 24*b* can be secured to stationary base 20** in any suitable manner, such as by adhesive or the like.

Movable display rack assembly 18 further includes a trolley 30 which includes a substantially flat, rectangular member 32 which is horizontally oriented and two flange members **34*a* and 34*b* which extend downwardly from the underside of flat member 32 in substantially parallel, spaced relation within the area defined between tracks 24*a* and 24*b*. A plurality of axles 36*a* and 36*b* extend outwardly from flange members 34*a* and 34*b*, respectively, through openings 28*a* and 28*b* to the interior of tracks 24*a* and 24*b*. A roller or wheel 38 is mounted to the free end of each axle 36*a* and 36*b* by means of bearings (not shown) such that rollers 38 freely rotate on axles 36*a* and 36*b* within C-shaped rails 26*a* and 26*b* so as to slidably support trolley 30 for movement in the direction of double-headed arrow 40 in FIG. 1. In addition, a covering flange member 42 extends downwardly from the forwardmost edge of flat rectangular member 32 in front of track 24*b*** so as to cover the same.

Movable display rack assembly 18 further includes a movable rack fixedly secured to the upper surface of flat rectangular member 32 of trolley 30. Specifically, movable rack 44 is effectively formed by an inverted U-shaped tube 46, with the upper end of tube 46, in addition, being bent outwardly in a horizontally oriented U-shaped portion which forms a handle 48 that can be grasped by a customer for sliding movable rack 46 in relation to fixed display wall 10. The lower, free ends **46*a* and 46*b* of tube 46 are fixedly secured, by welding, soldering or the like to thin metal strips 50*a* and 50*b*, respectively, which in turn, are fixedly secured to the upper surface of flat rectangular member 32 of trolley 30 in parallel, spaced relationship so as to extend substantially transversely to the direction of rails 26*a* and 26*b*. In this regard, thin metal strips 50*a* and 50*b* can be secured to flat rectangular member 32 of trolley 30 by any simple means, such as rivet pins 52 or the like which extend through suitable apertures 54 in thin metal strips 50*a* and 50*b* and through aligned apertures 56 in flat rectangular 32 of trolley 30. However, any other suitable arrangement for fixedly securing thin metal strips 50 to flat rectangular member 32** can be used within the scope of the present invention.

With the arrangement thus far described, movable rack 44 is vertically oriented in a fixed position on trolley 30, substantially parallel to fixed display wall 10 and is adapted to move in the lengthwise direction of fixed display wall 10 by movement of trolley 30 along tracks 24*a* and 24*b*.

In accordance with the present invention, in addition to the customer being able to move rack 44 so as to view and remove articles 16 from fixed display wall 10, the area defined within inverted U-shaped tube 46, that is, between the parallel upright sections 46*c* and 46*d* thereof, is preferably transparent, or at least partially transparent, so that the customer can view the articles 14 on fixed display wall 10 through those portions of movable rack 44 that are not covered by articles 16. One manner of achieving this is shown in FIGS. 1 and 2 in which movable rack 44 includes a plurality of thin wire rods 58 that extend horizontally between the vertical upright sections 46*c* and 46*d* of inverted U-shaped tube 46. For example, the inner facing portions of vertical upright sections 46*c* and 46*d* can have a plurality of holes spaced therealong for receiving the ends of wire rods 58. With this arrangement, a customer can view article 16 on fixed display wall 10 at those portions of movable rack 44 which are not covered by articles 16.

In order to carry a plurality of articles 16 on movable rack 44, a flat rectangular pegboard 60 is provided with a plurality of clips 62 at the rear surface thereof, and preferably at the upper and lower edges thereof such that clips 62 clip or hook onto respective wire rods 58 to removably secure pegboard 60 thereon. Pegboard 60 is provided with a plurality of holes 64 adapted to receive and hold a plurality of hooks 66 in a substantially identical manner to holes 12 and hooks 14 on fixed display wall 10. A plurality of articles 16 can be hung from hooks 66 for display and sale to the consumer. In addition, pegboard 60 can be made opaque to prevent viewing of articles 16 on fixed display wall 10, or alternatively, pegboard 60 can be made transparent so that, as articles 16 thereon are depleted, the consumer can view the articles 16 on fixed display wall 10 therethrough.

Figure 4:
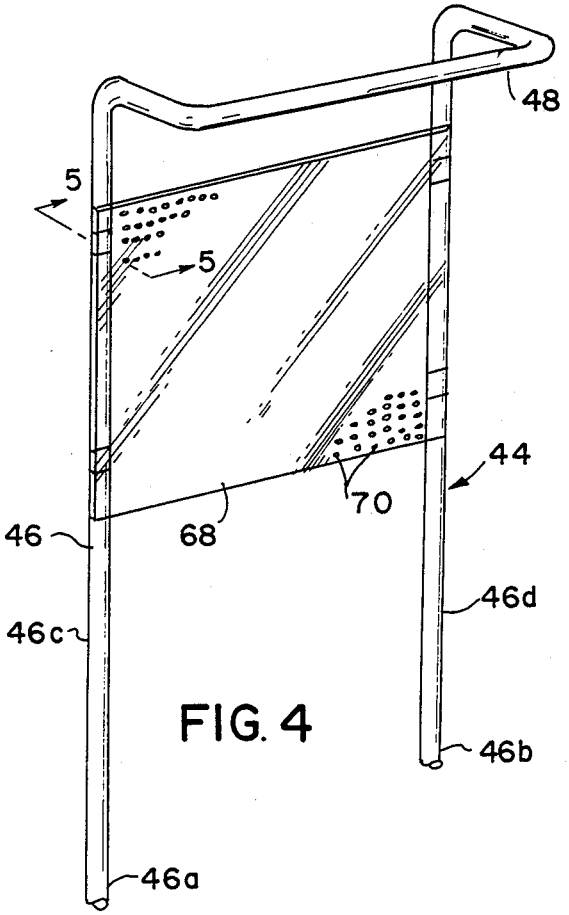
FIG. 4 is a perspective view of an upright rack according to another embodiment of the present invention for use with the movable display rack assembly of FIG. 1.
Figure 5:
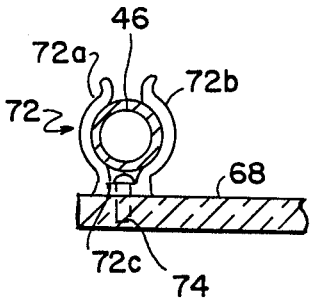
FIG. 5 is a cross-sectional view of the upright rack of FIG. 4 taken along line 5—5 thereof.

Of course, it will be appreciated that other arrangements can be provided for mounting articles 16 on movable rack 44. For example, as shown in FIGS. 4 and 5, wire rods 58 are eliminated and a transparent pegboard 68 is mounted directly to vertical upright sections 46*c* and 46*d* of inverted U-shaped tube 46, pegboard 68 having a plurality of holes 70 therein for receiving hooks 66 so as to support a plurality of articles 16 thereon. In this regard, and as shown best in FIG. 5, spring finger clips 72 are mounted to left and right upper edges at the rear surface of pegboard 68. Each spring finger clip 72 includes first and second spring fingers 72*a* and 72*b* having an opposing convex configuration and secured by a connecting section 72*c* which is secured to the rear of pegboard 68 by a screw 74 or the like. Thus, spring fingers 72*a* and 72*b* are adapted to engage tube 46 in a known manner to secure pegboard 68 on inverted U-shaped tube 46.

With either embodiment, the consumer merely grasps handle 48 to move rack 44 and trolley 30 in the direction of arrow 40 in FIG. 1 in order to view and obtain access to articles 16 mounted on fixed display wall 10. At the same time, movable rack 44 presents additional articles 16 to the consumer so as to increase the usable space without requiring a substantial change in an already existing retail store. Thus, there is no need to provide any overhead tracks with the present invention. In addition, tipping of movable rack 44 forwardly or rearwardly is prevented since movable rack 44 is fixedly secured to trolley 30, and trolley 30 is supported along two parallel tracks 24*a* and 24*b*. Thus, the present invention does not require any bracing at the upper end of movable rack 44. In addition, because of the use of wire rods 58 and/or transparent pegboards 60 and 68, the consumer can view the articles 16 on fixed display wall 10 through movable rack 44 at portions thereof where there are no articles mounted.

Having described specific preferred embodiments of the invention with reference to the accompanying drawings, it will be appreciated that the present invention is not limited to those preferred embodiments and that various changes and modifications can be effected therein by one of ordinary skill in the art without departing from the spirit or scope of the invention as defined by the appended claims.

What is claimed is:

1. A movable pegboard display assembly for use with a fixed display wall and a stationary base positioned in front of and at a lower position with respect to the fixed display wall, said movable display assembly comprising:

upright rack means for supporting a plurality of articles thereon, said upright rack means including a lower end and an unsupported and unguided upper free end extending for a substantial height of said fixed display wall, said upright rack means including pegboard means for supporting the plurality of articles thereon;

trolley means for movably supporting said lower end on top of said stationary base; and means for fixedly securing said lower end of said upright rack means on said trolley means.

2. A movable display assembly according to claim 1; wherein said upright rack means has an inverted substantially U-shaped configuration.

3. A movable display assembly according to claim 2; wherein said upright rack means is formed by a tubular member into said inverted substantially U-shaped configuration.

4. A movable display assembly according to claim 3; wherein said tubular member is bent forwardly at said upper free end of said upright rack means to form a handle therefor.

5. A movable display assembly for use with a fixed display wall, said movable display assembly comprising:

a stationary base positioned in front of the fixed display wall;

upright rack means for supporting a plurality of articles thereon, said upright rack means including a lower end and an upper free end, said upright rack means being formed by a tubular member into an inverted substantially U-shaped configuration, said tubular member including two parallel spaced upright sections, and said upright rack means further including a plurality of wire rod means extending between said upright sections for supporting a plurality of articles thereon; and means for movably supporting said lower end on said stationary base.

6. A movable display assembly according to claim 5; wherein said plurality of wire rod means extend horizontally in spaced relation between said spaced upright sections.

7. A movable display assembly according to claim 6; wherein said upright rack means includes pegboard means for supporting a plurality of articles thereon, said pegboard means including clip means for removably securing said pegboard means on said plurality of wire rod means.

8. A movable display assembly according to claim 7; wherein said pegboard means is transparent.

9. A movable display assembly according to claim 3; wherein said tubular member includes two parallel spaced upright sections, and said pegboard means is mounted to said spaced upright sections for supporting a plurality of articles thereon.

10. A movable display assembly for use with a fixed display wall, said movable display assembly comprising:

a stationary base positioned in front of the fixed display wall;

upright rack means for supporting a plurality of articles thereon, said upright rack means including a lower end and an upper free end, said upright rack means being formed by a tubular member into an inverted substantially U-shaped configuration, said tubular member including two parallel spaced upright sections, said upright rack means further including pegboard means mounted to the spaced upright sections for supporting a plurality of articles thereon, and said pegboard means is transparent; and means for movably supporting said lower end on said stationary base.

11. A movable display assembly according to claim 1; wherein said trolley means for movably supporting includes a plurality of roller means for movably supporting said lower end of said upright rack means on said stationary base.

12. A movable pegboard display assembly for use with a fixed display wall and a stationary base positioned in front of and at a lower position with respect to the fixed display wall, said movable display assembly comprising:

a trolley;

means for movably supporting said trolley on top of said stationary base;

upright rack means for supporting a plurality of articles thereon, said upright rack means including a lower end and an unsupported and unguided upper free end extending upwardly for a substantial height of said fixed display wall, said upright rack means including pegboard means for supporting the plurality of articles thereon; and means for fixedly securing said lower end of said upright rack means on said trolley.

13. A movable display assembly according to claim 12; wherein said means for movably supporting includes first and second track means fixedly mounted on said base, and roller means mounted for rotation on said trolley and in engagement with said first and second track means for movably supporting said trolley on said base.

14. A movable display assembly according to claim 13; wherein said first and second track means are formed by substantially C-shaped rails, each having an opening extending longitudinally therealong and the openings of said first and second track means being in opposing relation; and said means for movably supporting includes axle means secured to said trolley for supporting said roller means, each said axle means extending through an opening in said first and second track means and having a free end on which said roller means is supported for rotation within said first and second track means.

15. A movable display assembly according to claim 14; wherein said trolley includes a substantially flat member having downwardly extending flange members substantially parallel to each other and positioned between said first and second track means; and said axle means extend from said flange members to said first and second track means.

16. A movable display assembly according to claim 13; wherein said first and second track means extend in a substantially parallel relation with respect to said fixed display wall.

17. A movable display assembly according to claim 12; wherein said upright rack means has an inverted substantially U-shaped configuration.

18. A movable display assembly according to claim 17; wherein said upright rack means is formed by a tubular member into said inverted substantially U-shaped configuration.

19. A movable display assembly according to claim 18; wherein said tubular member is bent forwardly at said upper free end of said upright rack means to form a handle therefor.

20. A movable display assembly for use with a fixed display wall, said movable display assembly comprising:

a stationary base positioned in front of the fixed display wall;

a trolley;

means for movably supporting said trolley on said base; and upright rack means for supporting a plurality of articles thereon, said upright rack means including a lower end fixedly supported on said trolley and an upper free end, said upright rack means being formed by a tubular member into an inverted substantially U-shaped configuration, said tubular member including two parallel spaced upright sections, and said upright rack means further including a plurality of wire rod means extending between said upright sections for supporting a plurality of articles thereon.

21. A movable display assembly according to claim 20; wherein said plurality of wire rod means extend horizontally in spaced relation between said spaced upright sections.

22. A movable display assembly according to claim 21; wherein said upright rack means includes pegboard means for supporting a plurality of articles thereon, said pegboard means including clip means for removably securing said pegboard means on said plurality of wire rod means.

23. A movable display assembly according to claim 22; wherein said pegboard means is transparent.

24. A movable display assembly according to claim 18; wherein said tubular member includes two parallel spaced upright sections, and said pegboard means is mounted to said spaced upright sections for supporting a plurality of articles thereon.

25. A movable display assembly for use with a fixed display wall, said movable display assembly comprising:

a stationary base positioned in front of the fixed display wall;

a trolley;

means for movably supporting said trolley on said base; and upright rack means for supporting a plurality of articles thereon, said upright rack means including a lower end fixedly supported on said trolley and an upper free end, said upright rack means being formed by a tubular member into an inverted substantially U-shaped configuration, said tubular member including two parallel spaced upright sections, said upright rack means further including pegboard means mounted to the spaced upright sections for supporting a plurality of articles thereon, and said pegboard means is transparent.

26. A movable display assembly according to claim 12; wherein said means for movably supporting includes a plurality of roller means for movably supporting said trolley on said stationary base.

* * * * *